United States Patent [19]

Espe

[11] Patent Number: 4,646,634

[45] Date of Patent: Mar. 3, 1987

[54] METHOD FOR PRODUCING EMBOSSED GROOVES ON IMPREGNATED DESIGN PAPER

[75] Inventor: Rolf Espe, Bochum, Fed. Rep. of Germany

[73] Assignee: Eduard Hueck, Lüdenscheid, Fed. Rep. of Germany

[21] Appl. No.: 690,573

[22] Filed: Jan. 10, 1985

[30] Foreign Application Priority Data

Jan. 10, 1984 [DE] Fed. Rep. of Germany ..... 3400557

[51] Int. Cl.[4] ..... B31F 1/07

[52] U.S. Cl. ..... 101/32; 101/27

[58] Field of Search ..... 101/32, 23, 27

[56] References Cited

U.S. PATENT DOCUMENTS

| | | | |
|---|---|---|---|
| 805,699 | 11/1905 | Avril | 101/23 |
| 2,054,313 | 9/1936 | Bright | 101/23 |
| 2,849,752 | 9/1958 | Leary | 101/23 X |
| 2,855,844 | 10/1958 | Stewart | 101/23 |
| 3,247,785 | 4/1966 | Shultz | 101/23 |
| 4,154,882 | 5/1979 | Ungar et al. | 101/32 X |

FOREIGN PATENT DOCUMENTS

| | | | |
|---|---|---|---|
| 92588 | 6/1983 | Japan | 101/32 |

*Primary Examiner*—Clifford D. Crowder

*Attorney, Agent, or Firm*—Michael J. Striker

[57] ABSTRACT

A method for producing ink embossed grooves on design paper by means of an upper surface textured pressure plate or an endless belt, whereby the pressure plate along with the design paper, that has been previously impregnated, forms a pressure package when pressed together in a plate-heat press. According to the invention unprinted paper is used as the design paper and the pressure plate is printed on raised portions. After pressing in the heat press the ink color is seated in exact orientation with the embossed grooves in the impregnating layer.

1 Claim, 4 Drawing Figures

METHOD FOR PRODUCING EMBOSSED GROOVES ON IMPREGNATED DESIGN PAPER

BACKGROUND OF THE INVENTION

The present invention relates to a method for producing inked embossed grooves on impregnated and precondensed design paper or similar base materials, by use of a metallic, surface textured pressure plate or a matching die consisting of an endless belt, whereby the die together with the design paper is pressed into a pressure package by pressure and heat application.

A method for manufacturing colored embossed design layers is known from DE-OS 2,357,831. According to this known method an amino plastic resin impregnated design layer in a printed or an inked condition is placed on a textured pressure plate. The design layer and the pressure plate comprise a pressure package which is placed inside a heat press and pressed together. By this method, the colored embossed designed layers are achieved by differing pressure application of the pressure plate, wherein during the melting process of the resin a transportation of the color pigment component takes place, resulting in a reduction of pigment in the zones of high pressure and a concentration of pigment in the zones of low pressure. The disadvantage of this method is that due to the resin in the design paper it is not possible to exactly predetermine the transportation of the color portion during the pressing of the package in the heat press. This leads to differing shades in the color in the paper and therefore an exact correspondence between the design and the texture of the pressure plate is not obtainable.

A further chemical embossing method for manufacturing decorative plates is known from DE-PS 1,942,780. According to this method before the resin impregnation of the upper surface, a plywood base provided with a design print causes the print color to be enriched with inhibitors. Thereby, since the impregnation of the design paper occurs after this printing is undertaken and that the printing colors used contain resin repelling ingredients, the impregnating layer has the ability to effectively protect the other portions of the design paper that are not covered with dye. By the associated pressing process, the die line covered impregnating layer is displaced or exposed by the inhibitors. This results in the following problem, by subsequent action of humidity, steam, acidity and similar conditions, the paper fibers are laid open because of the unreachable impregnation protection on the die markings which causes the design paper at these positions to swell.

SUMMARY OF THE INVENTION

It is an object of the present invention to provide a method that will overcome the deficiencies of the prior art and that will use a pressure plate having a structure that provides exact synchronous printing on the design paper.

Pursuant to this object, and others which will become apparent hereinafter, one aspect of the inventive method resides in unprinted paper being used as design paper and before bringing the pressure package into the heat press only the pressure plate is printed on with a texture.

By the method according to the invention, a subsequent swelling of the design paper, as a result of exposure of unimpregnated paper fibers, is avoided. According to the invention, the printing marks are not brought onto the design paper prior to impregnation, but rather after impregnation. Thereby it is proved, that the printing color contour is reproducible on the impregnating layer of the design paper without being distorted, covering the exact same location as the texture lines of the embossing plate or an endless band engraved in the design paper. The ink color is thereby embedded into the impregnating layer without leaving residue, thereby being protected from abrasion and chemical influences.

The novel features which are considered as characteristic for the invention are set forth in particular in the appended claims. The invention itself, however, both as to its construction advantages thereof, will be best understood from the following description of the specific embodiments when read in connection with the accompanying drawings.

DETAILED DESCRIPTION OF THE PREFERRED EMBODIMENTS

Figure 1:
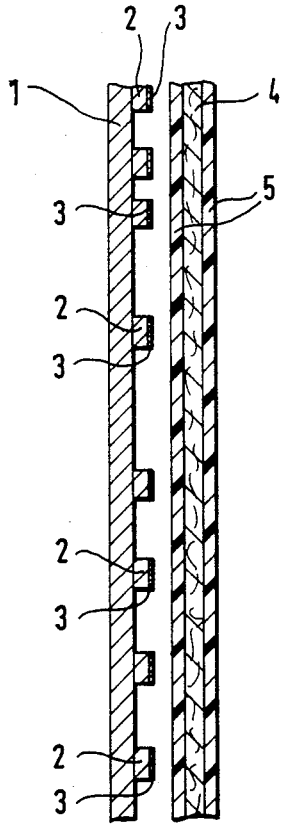
FIG. 1 illustrates the pressure package before being brought into the heat press.

As seen in FIG. 1, the entire pressure plate is indicated with the number 1. The raised contour lines of the plate are indicated with the number 2, and the ink color coating with the number 3. The design paper of common construction is given the number 4 and the impregnating layer is indicated with the number 5.

Figure 2:
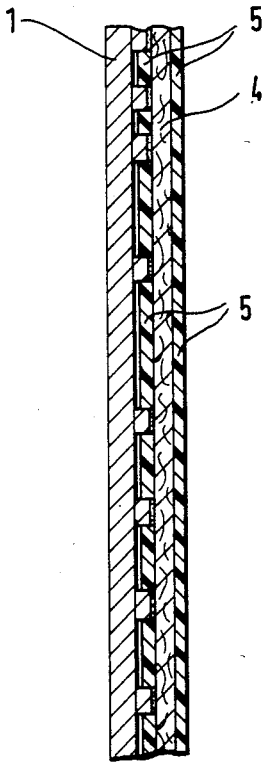
FIG. 2 illustrates the pressed design paper after removal from the heat press.

The design paper 4 serves as a base which is, to begin with, completely impregnated with an amino plastic-condensation resin 5 and is precondensed in a heat chamber. The pressure plate 1 is then applied, causing the raised contour lines 2 which are preinked with the printing ink 3 to contact the design paper 4. Up to this point the design paper is not printed on. Instead of single layered papers, papers made of numerous layers can also be used, depending on what the practice dictates. The above-described steps result in the formation of a pressure package which is next placed in a hydraulic plate press and pressed together. At the same time, a final condensation and solidification take place. The pressing and solidification result from a temperature of approximately 170° C. and a pressure of 85 kp/cm$^2$. The entire duration of pressing lasts 60 minutes. After that the pressure package is removed from the plate press and the design paper is separated from the pressure plate. With this method, the printing ink is embossed without residue into the impregnating layer 5 of the design paper 4 so that it covers exactly the texture pattern of the raised portion of the plate (FIG. 2).

Figure 3:
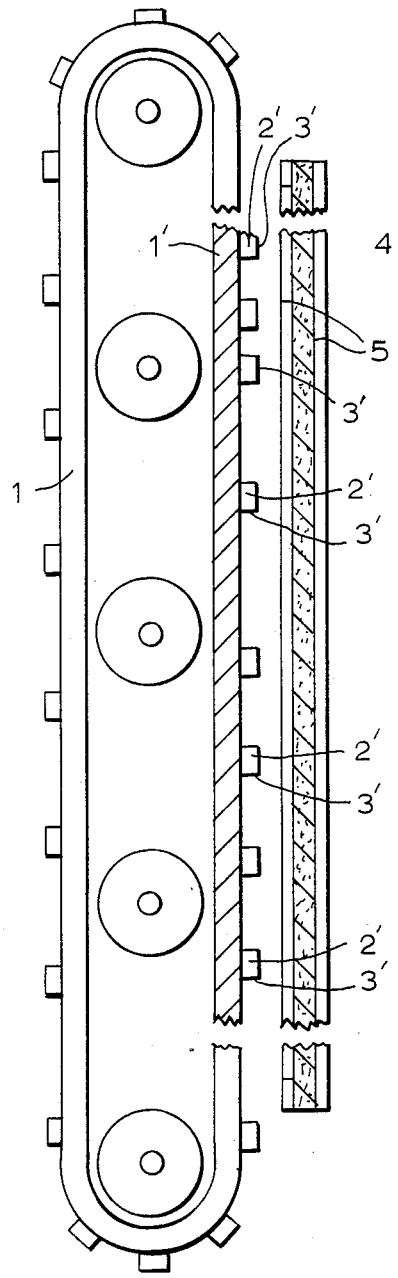
FIG. 3 illustrates the pressure package before being brought into the heat press wherein the textured pressure member is formed as an endless belt.
Figure 4:
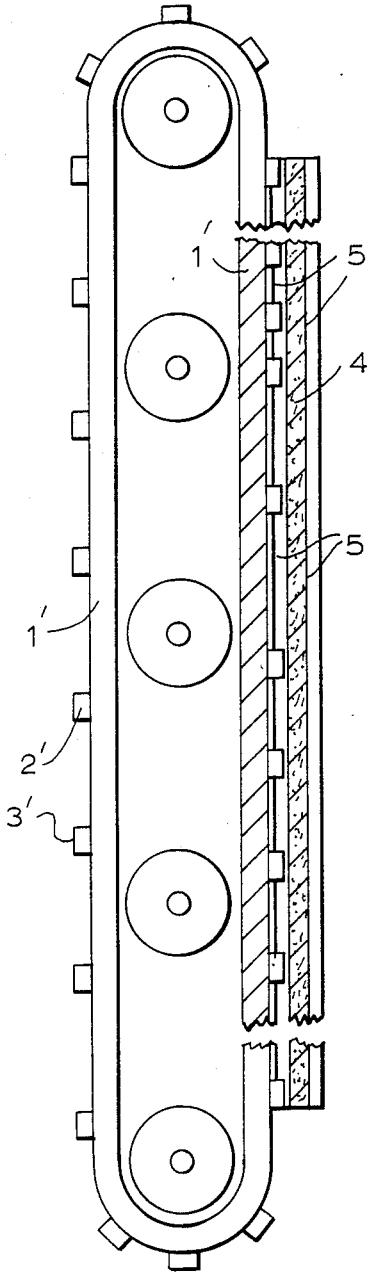
FIG. 4 shows the endless belt embodiment after removal from the heat press.

FIGS. 3 and 4 show another embodiment of the invention in which instead of the pressure plate 1, an endless belt 1' is used and reference numerals 2' identify the raised contour lines on the belt, while reference numerals 3' identify the ink color coating.

The design paper 4 can be coated on both its sides with the resin 5. The raised contour lines 2 completely penetrate the coating of resin 5 on one side of the design paper 4 and print on that one side.

While the invention has been illustrated and described as embodied in a method for producing embossed grooves on impregnated design paper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various amplifications without omitting features that, from the standpoint of prior art, fairly constitute essential characteristics of the generic or specific aspects of this invention.

What is claimed as new and desired to be protected by Letters Patent is set forth in the appended claims:

1. A method for producing inked embossed grooves on impregnated and precondensed design paper or similar base material, comprising the steps of: providing an unprinted design paper; providing a metal pressure plate having raised contact portions; applying a printing ink only on the raised contact portions and not on the design paper; pressing the textured metal pressure plate and the design paper together in a heat press at a temperature of approximately 170° C. and a pressure of approximately 85 kg/cm$^2$ for substantially 60 minutes to form a pressure package so as to emboss the design paper and transfer the printing ink from the textured metal pressure plate onto depressions of the design paper; removing the pressure package from the heat press; and separating the textured metal pressure plate from the design paper.

* * * * *